United States Patent [19]

Barkow et al.

[11] 4,357,586

[45] Nov. 2, 1982

[54] COLOR TV DISPLAY SYSTEM

[75] Inventors: William H. Barkow, Pennsauken; Josef Gross, Princeton, both of N.J.

[73] Assignee: RCA Corporation, New York, N.Y.

[21] Appl. No.: 149,681

[22] Filed: May 14, 1980

[51] Int. Cl.[3] ..... H01F 3/00

[52] U.S. Cl. ..... 335/211; 335/214

[58] Field of Search ..... 315/370, (U.S. only), 315/13 C (U.S. only); 313/429, 431, 437; 335/211, 214

[56] References Cited

U.S. PATENT DOCUMENTS

| | | | |
|---|---|---|---|
| 2,817,782 | 12/1957 | Over et al. | 335/211 |
| 3,274,418 | 9/1966 | Crumly | 313/431 |
| 3,495,124 | 2/1970 | Thompson et al. | 315/370 X |
| 3,505,560 | 4/1970 | Marvin | 335/211 X |
| 4,237,437 | 12/1980 | Vink et al. | 335/211 |
| 4,246,560 | 1/1981 | Shimizu et al. | 335/212 |

FOREIGN PATENT DOCUMENTS

| | | |
|---|---|---|
| 2010005 | 6/1979 | United Kingdom . |
| 2013972 | 8/1979 | United Kingdom . |

OTHER PUBLICATIONS

"Deflection Yoke for Dynamic Raster Distortion Correction Free Color Picture Tube", Toshiba New Product Information, pp. 1-12.

*Primary Examiner*—Malcolm F. Hubler
*Attorney, Agent, or Firm*—Paul J. Rasmussen; William H. Meagher; Scott J. Stevens

[57] ABSTRACT

A self-converging deflection yoke having toroidally-wound vertical deflection coils incorporates a pair of magnetically permeable field formers mounted on either side of the yoke. The field formers shunt a portion of the external field flux to the vicinity of the electron gun assembly where they form a pincushion-shaped field which aids in vertical coma correction. In one embodiment, a yoke comprising planar-wound vertical coils incorporates both coma-correcting rear field formers and a pair of front crossarm assemblies for providing side-pincushion correction. The resultant yoke provides covergence of electron beams free of coma and side-pincushion distortion with reduced sensitivity to transverse motion. In another embodiment, similar results are obtained without the front crossarms by vertical deflection coil having a nonradial winding configuration.

7 Claims, 7 Drawing Figures

COLOR TV DISPLAY SYSTEM

This invention relates generally to self-converging deflection yokes and in particular to a novel self-converging yoke arrangement exhibiting substantial freedom from coma errors.

A color television receiver forms a picture on a phosphor display screen of a multi-beam color picture tube by scanning three electron beams horizontally and vertically across the screen in a predetermined pattern by a magnetic deflection yoke. Each electron beam strikes particular color-producing phosphors, so that the individual beams may be designated the red, green and blue beam. The beams are constrained to strike only particular phosphors by a shadow mask or an aperture grill mounted between the electron gun assembly and the screen. The extent to which this shadowing occurs determines the purity of the rasters scanned by each beam. It is desirable that the three electron beams land on the screen in close proximity to each other in order to provide proper color reproduction and prevent color fringing in the picture. The proximity of beam landing determines the convergence of the beams on the screen.

With a kinescope having the three electron guns positioned in a horizontal line, it is possible to manufacture a deflection yoke which substantially converges the beams at all points on the screen without the need for dynamic convergence circuits. Such yokes however may produce coma errors and raster distortion. Because the screen is relatively flat, the beams traverse a greater distance in reaching the corners of the screen than its center. This results, in the absence of compensation therefor, in a pincushion-shaped raster with the top and bottom and side edges bowed inward. Nonuniform deflection fields with a pincushion-shaped transverse pattern are appropriate for correction of top-and-bottom and side pincushion distortion.

In design of a yoke for substantial self-convergence, it is desired that the horizontal deflection coils produce a field having a net negative isotropic astigmatism, such as is caused by a pincushion-shaped deflection field, while it is desired that the vertical coils produce a field having a net positive isotropic astigmatism, such as is caused by a barrel-shaped deflection field. The pincushion-shaped field produced by the horizontal deflection coils in such a yoke therefore tends to correct pincushion distortion, while the barrel-shaped vertical deflection field tends to aggravate it. It is therefore easier in self-converging yokes to design horizontal deflection coils which correct top-and-bottom pincushion distortion than to correct side pincushion distortion with the vertical coils.

A mathematical analysis using third-order aberration theory to determine the nature of the electron-beam deflection shows that the deflection field at different locations along its longitudinal axis has a more pronounced effect on certain convergence or distortion characteristics than on others. It is known that pincushion distortion is most greatly affected by the deflection field at the screen end of the yoke, while coma errors (size differences between the center-beam raster and those of the outer beams) are more sensitive to the field at the gun-end of the yoke. By winding the yoke to have different field nonuniformities at successive locations along its longitudinal axis, it is possible to achieve self-convergence and correction of coma and raster distortion errors, as explained in greater detail in U.S. patent application Ser. No. 070,311 filed Aug. 27, 1979. With a deflection yoke having saddle-type horizontal deflection coils and toroidally-wound vertical coils, it is relatively easy to configure the horizontal windings to give the desired field nonuniformity function that results in top-and-bottom pincushion correction and coma-free convergence at the ends of the horizontal axis of the raster. The vertical coils, however, are more difficult to configure to give the desired nonuniformity function that results in side-pincushion correction and coma-free convergence at the ends of the vertical axis of the raster, and it is often necessary to provide additional means of vertical coma and side-pincushion correction to produce an acceptable picture.

The magnetic field generated by the yoke extends over an internal and an external region. The two regions are bounded by a surface defined by the inside contour of the yoke core. This boundary extends beyond the front and rear of the yoke at a distance from the tube substantially equal to that inside the yoke. The internal field is comprised of the main deflection field bounded by the coils of the yoke, and of the entrance- and exit-fringe fields that also contribute to deflection. The external stray field does not contribute to deflection of the beams and represents wasteful power consumption of the yoke.

It is known that bias-wound vertical deflection coils can produce a vertical deflection field having an extended pincushion-shaped nonuniformity near the entrance region of the yoke that will act to correct vertical coma of the type where the height of the uncorrected center beam raster is less than that of the rasters of the outer beams. However, the vertical field nonuniformity must be predominately barrel-shaped to provide proper beam convergence, so an increase in main field barrelling must occur to compensate for the extended coma-correcting pincushion field at the entrance of the yoke. This aggravates the side pincushion distortion of the raster.

British patent application No. 2,013,972 illustrates an arrangement comprising field formers disposed at the rear of the yoke to distort a portion of the vertical deflection field into a pincushion shape. The field formers illustrated, however, are located so as to shunt a portion of the main deflection field and hence they reduce the overall barrelling of the vertical deflection field. A compensating increase in the barrel component of the field must occur to maintain correct beam convergence. The field formers shown also cause horizontal coma.

In accordance with the present invention, there is provided a means for collecting external stray flux from a deflection coil and channelling that flux to the rear of the yoke to form a localized pincushion-shaped field there for correcting coma errors that are introduced by the deflection field of the deflection coil. These field formers can be used to correct vertical coma caused by the deflection field of the vertical deflection coil. They can be used with a yoke having easily-wound vertical coils. The coma-correcting field is not formed at the expense of the main deflection field and does not aggravate side pincushion distortion or cause horizontal coma errors. In one illustrative embodiment, the coma-correcting means are coupled to a self-converging yoke having coma- and top- and bottom-pincushion-corrected saddle-type horizontal windings and nonradial toroidally-wound vertical windings for providing side pincushion correction. The resulting yoke is self converging, its convergence is insensitive to transverse positioning on the tube neck, and it requires no additional pincushion or coma correction. Another illustrative embodiment achieves similar results through the use of radial or planar-wound vertical windings in association with side pincushion-correcting front crossarms and the coma-correcting field formers.

Figure 1:
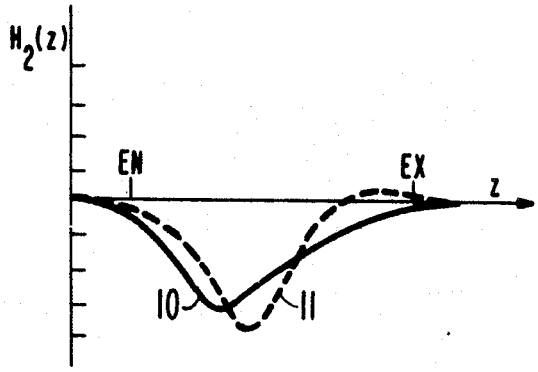
FIG. 1 is a graph of the vertical deflection field nonuniformity function for different windings, of aid in explaining the principles of the present invention.

As previously stated, in order to provide the necessary positive isotropic astigmatism for electron beam convergence, the vertical deflection coils must be configured so as to produce a predominately barrel field. The shape of the deflection field is determined by the field nonuniformity function, or $H_2$. Curve 10 in FIG. 1 illustrates the nonuniformity function for a set of planar-wound vertical deflection coils. A negative nonuniformity function indicates a barrel-shaped field while a positive nonuniformity function represents a pincushion-shaped field. The horizontal axis of FIG. 1 represents the distance along the longitudinal axis of the tube, with positions EN and EX representing the entrance and exit planes of the deflection yoke, respectively. As seen in FIG. 1, planar-wound vertical coils provide a deflection field that is barrel-shaped everywhere. Such a yoke would indeed provide the necessary nonuniformity required for beam self convergence, but also would cause substantial vertical coma and side-pincushion distortion. Therefore, planar or radially-wound vertical deflection coils require additional correction circuitry or components to provide an acceptable television picture.

Curve 11 of FIG. 1 illustrates the field nonuniformity function for vertical deflection coils having a biased or nonradial winding configuration. The biased winding produces a pincushion field in the exit region of the yoke, which provides side-pincushion correction. The bias-wound vertical coils, like the planar-wound coils, cause vertical coma.

It is possible to wind the vertical coils with a nonradial winding configuration to provide a pincushion field at the entrance region of the yoke so as to correct for vertical coma, but this requires biasing opposite to that needed for side-pincushion correction. A yoke bias wound for vertical coma correction, therefore, exhibits substantial side-pincushion distortion. Winding of vertical coils in a manner effecting both coma and side-pincushion correction is difficult in that wide variations in the nonuniformity function are necessary. This can result in excessive nonuniformity magnitudes, thereby making beam convergence sensitive to transverse motion of the yoke on the tube neck.

Figure 2:
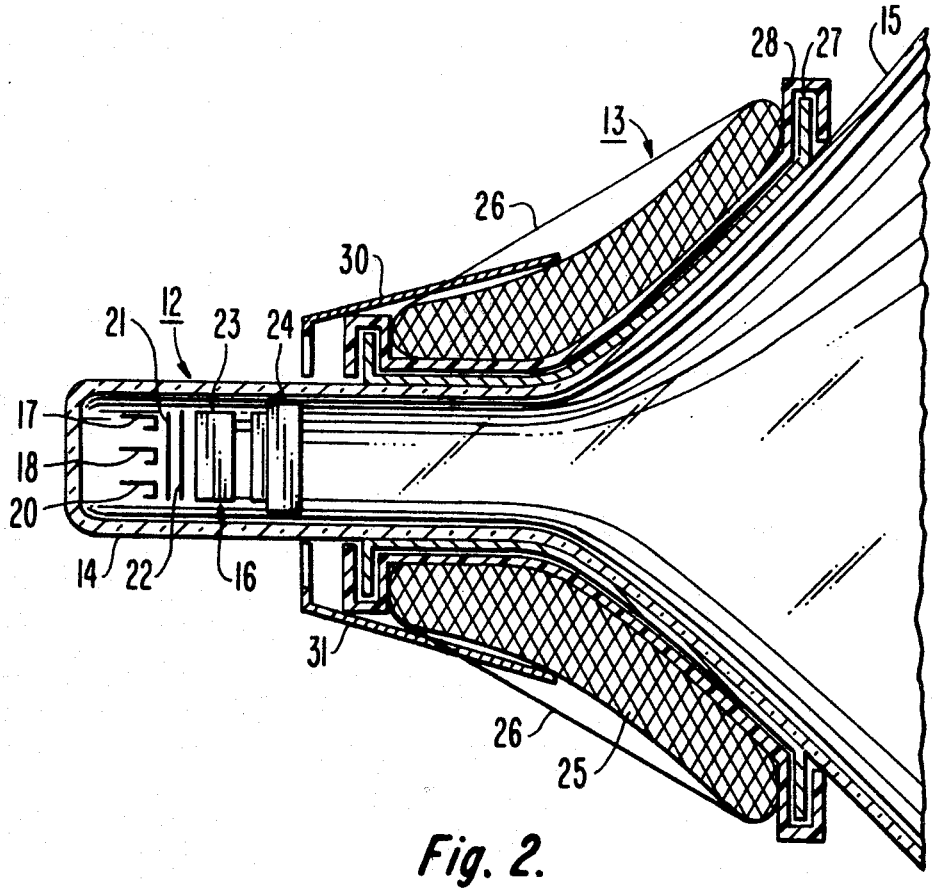
FIG. 2 is a top cross-sectional view of a yoke and kinescope combination embodying the principles of the present invention.

FIG. 2 illustrates a kinescope 12 on which is mounted a deflection yoke 13. The kinescope 12 comprises a neck portion 14 and a funnel region 15 which expands to form the bulb of the tube. A tube cap (not shown) incorporating the display screen is mounted to the bulb to form the completed tube. The yoke 13 is mounted on the kinescope 12 in the area where the neck portion 14 joins the funnel region 15. An electron gun assembly 16, comprising cathodes 17, 18 and 20, and electrodes 21, 22, 23 and 24, is disposed within the neck portion of the kinescope 12. Electrical leads to the exterior of the tube for supplying the necessary heater power, electrostatic potentials and signals to the electron gun assembly are not shown.

Figure 3:
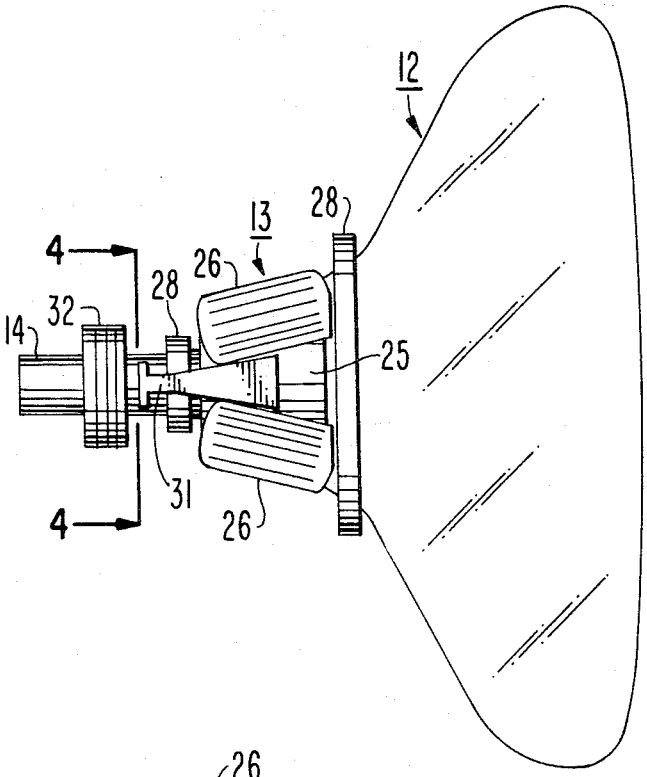
FIG. 3 is a side elevational view of the yoke and kinescope combination of FIG. 2, illustrating the location of field formers of the present invention relative to additional neck components.
Figure 4:
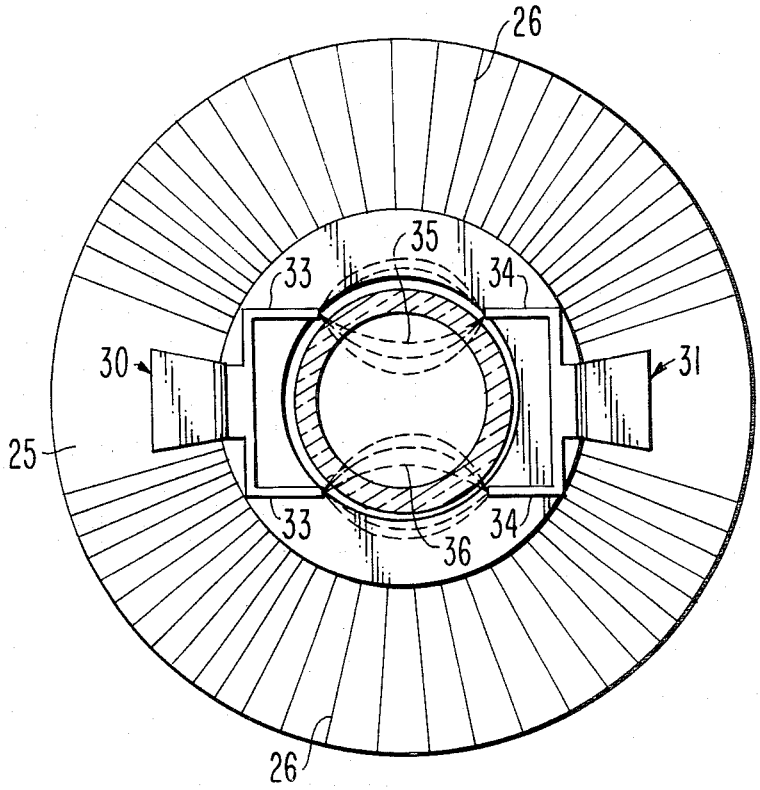
FIG. 4 is a cross-sectional view of the yoke and kinescope combination of FIG. 3 taken along line 4—4.

Yoke 13 comprises a magnetically permeable core 25 around which are toroidally wound the vertical deflection coils 26. The horizontal saddle-wound coils 27 are separated from the vertical windings by an insulator 28. FIG. 2 also illustrates a pair of magnetically permeable field formers 30 and 31 which extend from a point adjacent to core 25 to the vicinity of the exit region of the electron gun assembly 16. The field formers 30 and 31 extend from core 25 generally aligned with the tube's longitudinal axis, but angle toward the tube neck prior to their termination. This results in a portion of field formers 30 and 31 being substantially perpendicular to the direction of propagation of the electron beams from electron gun assembly 16. Referring to FIGS. 3 and 4, the operation of field formers 30 and 31 will now be described.

FIG. 3 shows a side view of the kinescope 12 and yoke 13 with field former 31 positioned between the vertical windings 26 on the core 25. A magnetic beam bender 32, which comprises a number of magnetic rings for providing static convergence of the electron beams, is shown positioned on the kinescope neck 14. The end of field former 31 remote from core 25 extends toward tube neck 14 between the insulator 28 of yoke 13 and beam bender 32. The field formers 30 and 31 are located so as to collect a portion of the external stray flux generated by the vertical deflection windings. By their nature, toroidally-wound coils produce a large amount of stray leakage flux at the sides and back of the yoke. Positioning the field formers 30 and 31 within this stray flux causes a portion of this flux to be channeled through field formers 30 and 31. A portion of the entrance-fringe flux is also channeled into field formers 30 and 31. A portion of the flux present in permeable core 25 may also be channeled in field formers 30 and 31. The field formers conduct this channeled flux to the rear of the yoke to enhance and shape the deflection field there.

The flux collected by field formers 30 and 31 from the external stray field and from core 25 is channeled through field formers 30 and 31 to the ends of field-former arms 33 and 34. A magnetic field is formed between corresponding arms 33 of field former 30 and corresponding arms 34 of field former 31, represented by field lines 35 and 36 in FIG. 4. Both field lines 35 and 36 appear to collect at the ends of arms 33 and 34 and expand between them, thereby forming a pair of barrel-shaped magnetic fields between corresponding arms 33 and 34 of field formers 30 and 31.

The upper region of the field represented by field lines 35 and the lower region of the field represented by field lines 36 tend to fall outside the kinescope neck 14. In the regions of the field which fall within the tube neck, a pincushion-shaped field is formed as can be seen in FIG. 4. This locallized pincushion field acts on the electron beams exiting the electron gun assembly as an extension of the main deflection field. The pincushion field provides the field nonuniformity necessary for vertical coma correction and is desirably located at the coma-sensitive entrance region of the deflection yoke. This coma-correcting pincushion field is formed by channeling stray and otherwise useless flux to the entrance region of the yoke. By collecting stray flux, field formers 30 and 31 aid in the deflection of the electron beams, and therefore this coma-correcting field reduces the power needed by the main deflection field. Additionally, by providing coma correction by external field formers rather than by the windings, the magnitude of field nonuniformity is reduced, thereby reducing the sensitivity of convergence to transverse yoke motion.

Figure 5:
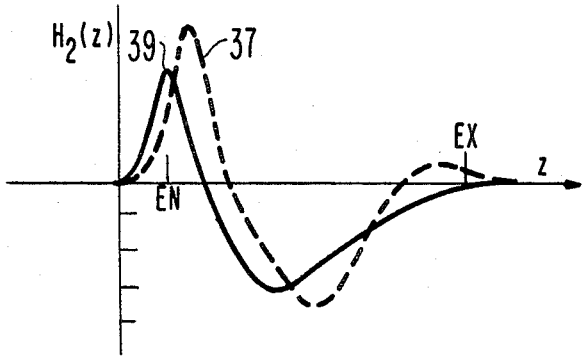
FIG. 5 is a graph of the vertical deflection field nonuniformity function for two different yokes illustrating the effect of the field formers shown in FIG. 4.

FIG. 5 shows the nonuniformity distribution for a planar-wound yoke (curve 39) and a bias-wound yoke (curve 37) utilizing field formers such as those described above.

Figure 6:
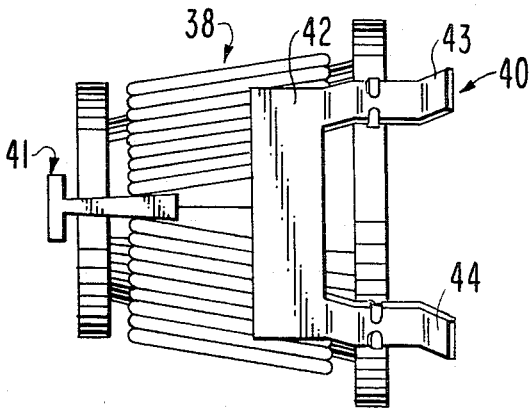
FIG. 6 is a side elevational view of a deflection yoke having front and rear field-forming assemblies, pursuant to a particular embodiment of the present invention.

The vertical winding represented by curve 39 has the mid-yoke barrel nonuniformity necessary for convergence and the entrance region pincushion nonuniformity necessary for coma correction, but still lacks the exit region pincushion nonuniformity necessary for side-pincushion correction. FIG. 6 illustrates a deflection yoke 38 having planar or radial-wound vertical coils with a front crossarm assembly 40, and rear field formers 41 according to the invention. A similar front crossarm assembly is mounted to the other side of yoke 38. Crossarm assembly 40 comprises a large vertically disposed flux collector 42 with an upper flux-channeling arm 43 and a lower flux-channeling arm 44. A front crossarm assembly is disclosed in British patent application No. 2,010,005. The front crossarm assembly generates a pincushion-shaped field in the region in front of yoke 38 to provide side-pincushion correction.

Figure 7:
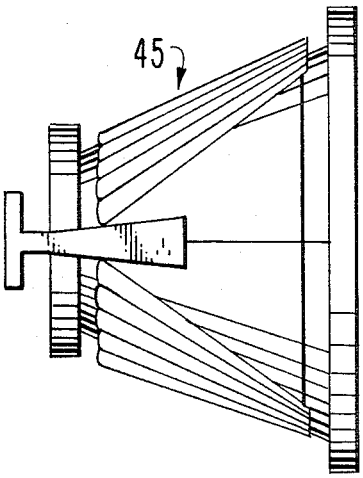
FIG. 7 is a side elevational view of a deflection yoke having a rear field-forming assembly and nonradial winding distribution of the vertical coil, pursuant to an additional embodiment of the present invention.

FIG. 7 illustrates a yoke 45 comprising bias or nonradially-wound vertical deflection coils and incorporating rear field formers according to the invention as previously described herein. From FIG. 7 it can be seen that the vertical coil turns on the yoke core are concentrated at the sides of the yoke nearer its back and become progressively more concentrated at the top and bottom of the yoke 45 near its front. Such a distribution provides the necessary pincushion nonuniformity in the exit region of the yoke to correct side-pincushion distortion. The nonuniformity distribution of yoke 45 would be similar to curve 37 in FIG. 5.

Each of yokes 38 and 45 in FIGS. 6 and 7, therefore, provide the necessary nonuniformity distribition to achieve electron beam convergence vertical coma and side-pincushion distortion correction, with reduced consumption of power and reduced sensitivity to transverse yoke motion.

What is claimed is:

1. In a television display system having a kinescope including a neck and an electron gun assembly therein for producing three electron beams, and a deflection yoke comprising a deflection coil toroidally wound about a magnetically permeable core encircling the paths of said beams departing said electron gun assembly, said coil producing a delfection field within the region bounded by the interior of said core and an external field; a magnetic field influencing apparatus comprising:

first and second magnetically permeable members respectively disposed on opposite sides of said yoke, each of said members having a first end disposed within said external field and a second end disposed at the rear of the entrance end of said deflection yoke and adjacent the neck of said kinescope, each of said members channeling a portion of said external field to its second end, each of said second ends being shaped in such manner as to form a pincushion-shaped field within said kinescope neck in the vicinity of said entrance end of said deflection yoke of such a magnitude and extent as to substantially correct coma errors otherwise introduced by said deflection field.

2. The arrangement defined in claim 1, wherein said second end of each of said magnetically permeable members defines an upper and lower arm disposed substantially perpendicular to said kinescope neck.

3. The arrangement defined in claim 1 wherein said first end of each of said magnetically permeable members is disposed adjacent said core for channeling a portion of the flux in said core into said permeable member.

4. The arrangement defined in claim 1 wherein said toroidally-wound deflection coil effects vertical deflection of said beams, and wherein said deflection yoke additionally includes a saddle-wound deflection coil for effecting horizontal deflection of said beams.

5. The arrangement defined in claim 4 wherein said vertical deflection coil comprises substantially radial windings and wherein said deflection yoke incorporates a pair of crossarm members disposed on either side of said yoke near the front of said yoke for producing a pincushion field in the vicinity of the front of said yoke for correcting side-pincushion distortion.

6. The arrangement defined in claim 4 wherein said vertical deflection coil comprises nonradial windings configured in a manner effecting correction of side-pincushion distortion.

7. In a television display system having a kinescope including a neck and an electron gun assembly therein for producing three electron beams, and a deflection yoke comprising a deflection coil toroidally wound about a magnetically permeable core encircling the paths of said beams departing said electron gun assembly, said coil producing a deflection field within the region bounded by the interior of said core and an external field; a magnetic field influencing apparatus comprising:

first and second magnetically permeable members respectively disposed on opposite sides of said yoke, each of said members having a first end disposed within said external field and a second end disposed at the rear of the entrance end of said deflection yoke and adjacent the neck of said kinescope, each of said members channeling a portion of said external field to its second end, each of said second ends being shaped in such manner as to form an upper and lower arm in order to form a pincushion-shaped field within said kinescope neck in the vicinity of said entrance end of said deflection yoke of such a magnitude and extent as to substantially correct coma errors otherwise introduced by said deflection field.

* * * * *